United States Patent [19]

Harris et al.

[11] Patent Number: 4,930,789

[45] Date of Patent: Jun. 5, 1990

[54] CASINO BOARD GAME

[76] Inventors: Diane F. Harris; Ted D. Harris, both of 6421 S. Mullen St., Tacoma, Wash. 98409

[21] Appl. No.: 246,641

[22] Filed: Sep. 20, 1988

[51] Int. Cl.[5] ..... A63F 3/00; A63F 3/08; A63B 71/00

[52] U.S. Cl. ..... 273/256; 273/274; 273/141 R

[58] Field of Search ..... 273/274, 256, 141 R, 273/293

[56] References Cited

U.S. PATENT DOCUMENTS

| | | | |
|---|---|---|---|
| 1,632,673 | 6/1927 | Paulus et al. | 273/274 |
| 3,633,915 | 1/1972 | Lippert | 273/274 |
| 3,889,954 | 6/1975 | Malisow | 273/256 |
| 4,397,467 | 8/1983 | Thornton | 273/256 |

FOREIGN PATENT DOCUMENTS

| | | | |
|---|---|---|---|
| 801964 | 9/1958 | United Kingdom | 273/243 |

*Primary Examiner*—Edward M. Coven
*Assistant Examiner*—Benjamin Layno

[57] ABSTRACT

A game of chance that simulates the playing of various gambling games in a casino type atmosphere. Apparatus includes a game board, upon which five separate paths of play are defined. One main path around its perimeter; and preferably four separate gaming paths that run within the interior of the board, each having its entrance and exit connected to the main path. The paths are divided into consecutive spaces, each bearing different instructions. Playing pieces of different colors are utilized by players to move around the spaces of the board. Play money is distributed to players, with the remainder in the bank. One deck reward cards, and one deck penalty cards form a supply for selection by players when a player lands on a reward or penalty space provided along the main path. Each space on the four separate gaming paths resembles a gambling game, e.g. black jack, roulette, slots, or poker. A spinner having a pointer and two interchangeable discs are used to play the gambling games. When a player lands on a gambling space, e.g. black jack, the appropriate black jack disc is placed on the spinner and black jack is played by spinning the pointer. The player' card hands are determined by the spinner. Play begins on main path and continues along any of four separate paths, object being to make enough money to win the game. The winner is the first player to obtain one million dollars.

2 Claims, 4 Drawing Sheets

LUCKY DAY CARDS

EXPENSE CARDS

CASINO BOARD GAME

BACKGROUND OF THE INVENTION

1. Field of the Invention

This invention relates to a novel game of entertainment, and more particularly to a game involving a game board and other game apparatus wherein luck determines the winner. Even more specifically, the present invention relates to an entertainment game in which a gaming vacation is amusingly simulated.

2. Introduction and Brief Description of Prior Art

A variety of different board games are known, however, to my knowledge a board game which simulates a gaming vacation environment has not heretofore been proposed. With an ever-increasing popularity in the gaming industry, a board game of this nature is not only entertaining, but one that allows players to experience the excitement of a real-life gaming environment in a simulated atmosphere.

SUMMARY OF THE INVENTION

1. Objects of the Invention

Accordingly, it is the general object of the present invention to overcome the detriments of the prior art board games.

Another object of this invention is to reliably simulate a real-life gaming environment in a game situation.

Another object of this invention is to provide a board game with a gaming vacation theme which is rich in excitement and entertainment reward.

Another object of this invention is the four separate paths within the interior of the board that simulates a gaming atmosphere in which games of chance for money are played.

Another object of this invention is the simulated real-life events that one incurs while on a gaming vacation that are incorporated in the spaces along the main path and in the reward and penalty cards.

Still another object of this invention is the use of two, two sided gaming discs in lieu of standard gaming tools.

2. Features of the Invention

In keeping with these objects and others which will become apparent hereinafter, one feature of the invention resides, and briefly stated, in a gaming vacation simulation game, and method of playing the same, for two or more players, which comprises playing pieces for each player, and a playing board in which preferably five separate paths of play are defined. The main path around the perimeter of the board simulates real-life situations incurred while vacationing in a gaming environment. This path of play defines a path by which financial rewards are obtained, allowing player to enter any of four separate gaming paths. Other intervals on the main path include those from which the player can accumulate money and those from which the player is required to pay expenses.

Once the player has accumulated sufficient money to enter a gaming path, play is transferred to one of preferably four separate paths within the interior, which simulates a gaming atmosphere.

On the four gaming paths, which defines a game of chance path, by which the performance of the player is measured, the player can win money, or detriments in the form of gaming losses can be incurred.

Once the player leaves the gaming path, play is transferred back to the main path to allow players to accumulate additional money or to allow player to advance to another gaming path.

The winner is the first player to obtain one million dollars. Other apparatus in the game includes two, two sided gaming discs, which represent two standard card games, a slot machine game, and a roulette game.

Additional advantages of this invention, as well as its significant features, can be obtained from the following detailed description of the preferred embodiment taken in conjunction with the drawings briefly described below.

DESCRIPTION OF THE PREFERRED EMBODIMENT

Figure 1:
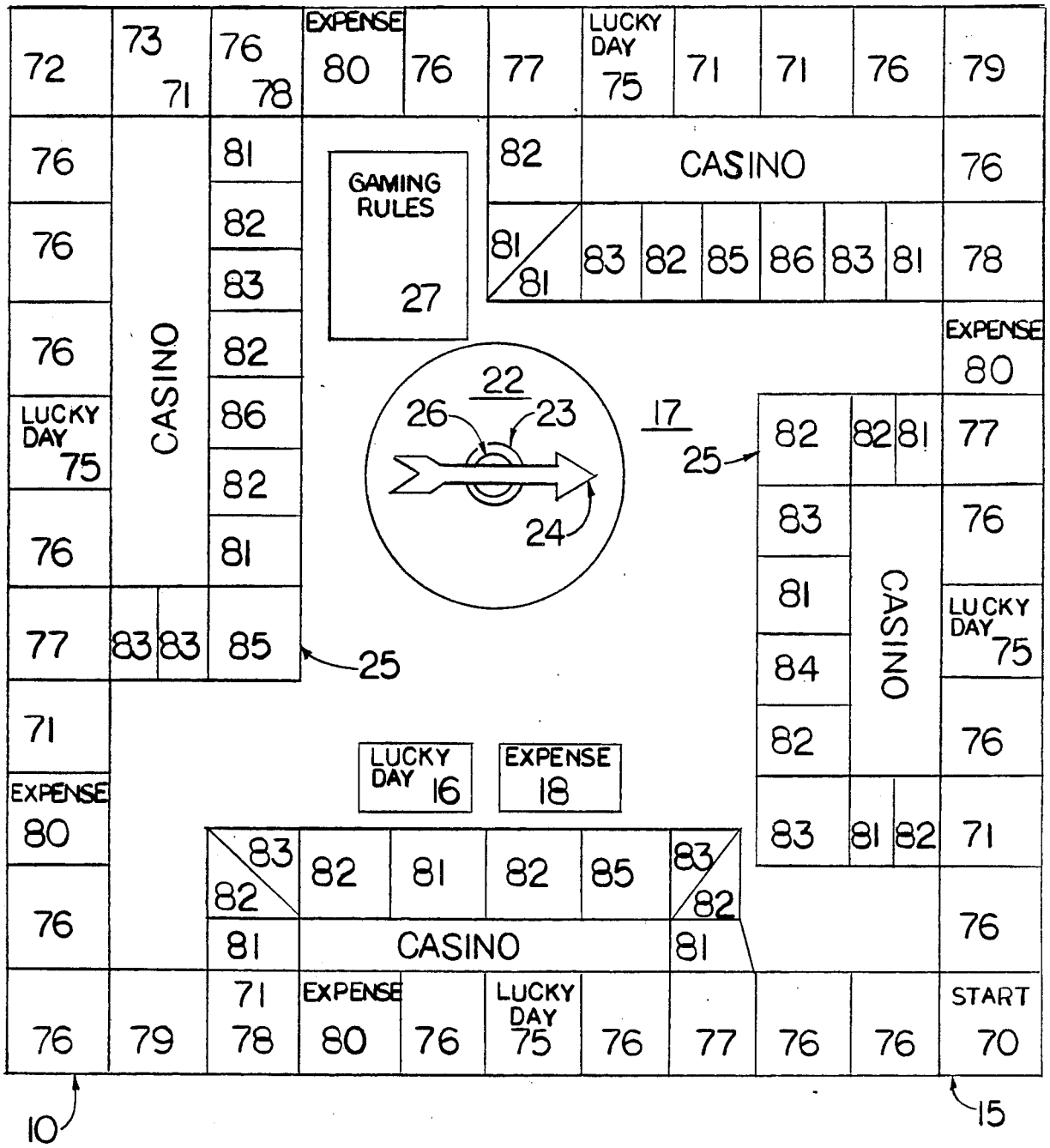
FIG. 1 is a plan view of a game board employed in the preferred embodiment of the present invention.
Figure 2:
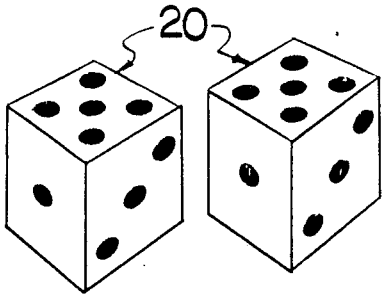
FIG. 2 is a perspective view of a pair of dice employed in the preferred embodiment.
Figure 3:
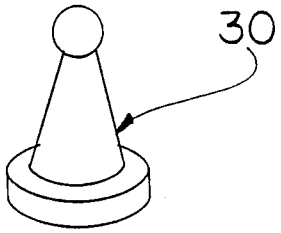
FIG. 3 is a perspective view of a plurality of playing pieces employed in the preferred embodiment.
Figure 4:
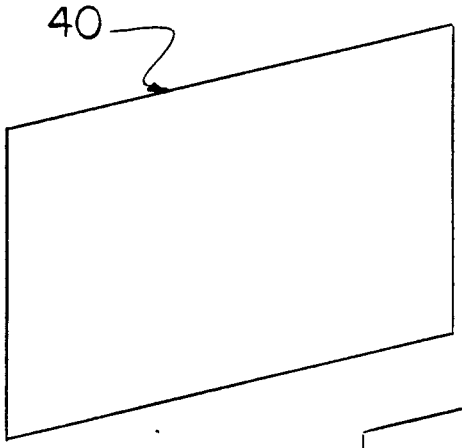
FIG. 4 is a perspective view of two types of cards employed in the preferred embodiment.
Figure 5:
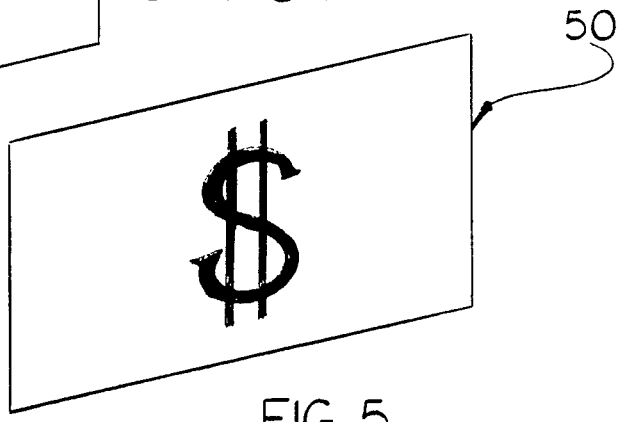
FIG. 5 is a perspective view of game money employed in the preferred embodiment.

Apparatus of the present game comprises a game board 10 shown in FIG. 1, a random number generating means such as a pair of dice 20 shown in FIG. 2, a plurality of preferably six playing pieces 30 shown in FIG. 3, a plurality of cards 40 shown in FIG. 4, which are lucky day cards and expense cards, game money 50 shown in FIG. 5, two, two sided gaming discs 60 shown in FIGS. 6 and 7, 8 and 9. Also included are a set of rules which may be printed and which serves as a means by which the game is dictated.

The game board 10 is preferably formed of a durable base material. The game board presents a playing surface which is defined into a main playing path 15 and into preferably four separate gaming paths 25 by, for example, printed indica on the playing surface. Each playing path 15 and 25 is formed by a plurality of serially connected intervals 70 to 86. The main path 15 is arranged in a continuous unending loop. The four gaming paths 25 are separate from one another and do not intersect, but each gaming path has its entrance and exit connected to the main path.

The main path 15 begins and ends at the same reference interval 70 marked START. The intervals 70 to 80 of the main path 15 define first stage play requirements and represent events which might occur on a gaming vacation. Intervals 75 and 80 represent lucky day and expense intervals which designate various rewards or penalties which the player receives when the playing piece 30 terminates movement on the intervals 75 and 80. As will be described subsequently, each lucky day cards and expense cards has printed thereon one of a variety of different rewards and penalties. A majority of the intervals of the main path 15 are reward or penalty intervals 75 and 80. Various other intervals, such as the intervals 71 involve games of chance similar to intervals of the gaming path 81 to 86. Interval 77 represents the entrance space of each gaming path. The gaming paths 25 begin at interval 77 and end at interval 78. The intervals 81 to 86 of the gaming paths define the second stage of play and represent different games of chance in a simulated gaming atmosphere.

The main path 15 is preferably arranged around the perimeter of the board 10. The gaming paths 25 preferably run within the interior of the board, each having its entrance 77 and exit 78 connected to the main path. Positions 16 and 18 are marked on the open space 17 in which the lucky day cards and expense cards respectively are to be positioned. The various intervals, paths, positions, and spaces on the game board 10 may be distinguished from one another by the indica thereon and by coloring.

Preferably in the center of the game board 10 is a large circle 21; in the center of the circle 22 is a base 23, adapted to receive a disc 60 and a rotably mounted snap on arrow 24. The disc 60 fits over a hub 26 on the base 23 and rests on the base 23 as seen in FIG. 1. Adjacent to the base 23 gaming rules and payoffs 27 for the gaming discs 60 are printed.

Figure 6:
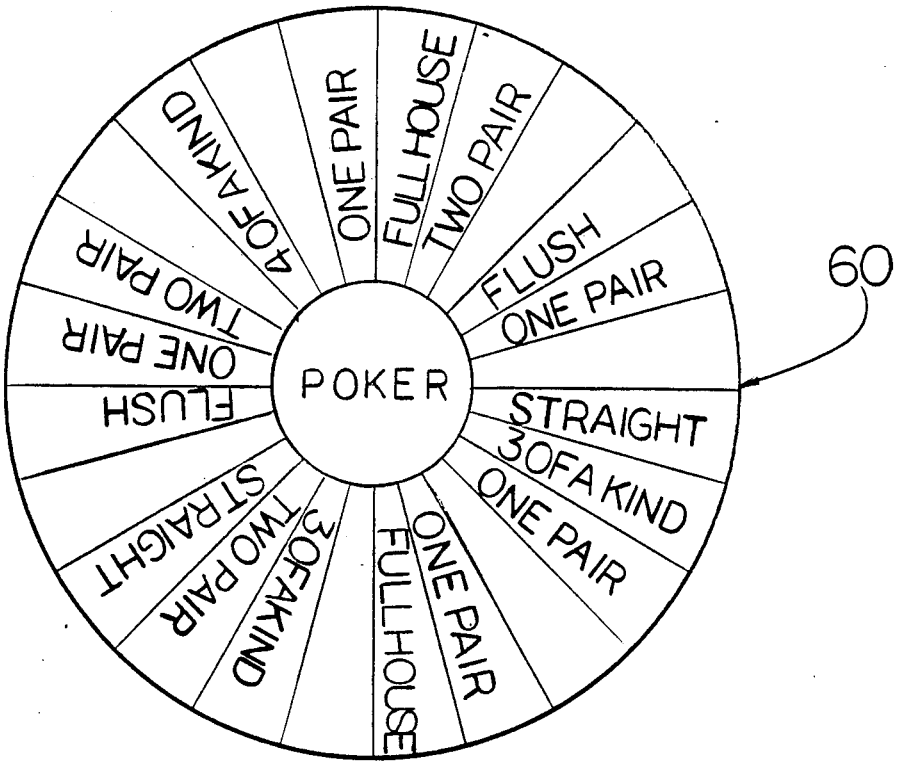
FIG. 6 is a front view of an element of one, two sided gaming disc employed in the preferred embodiment.
Figure 7:
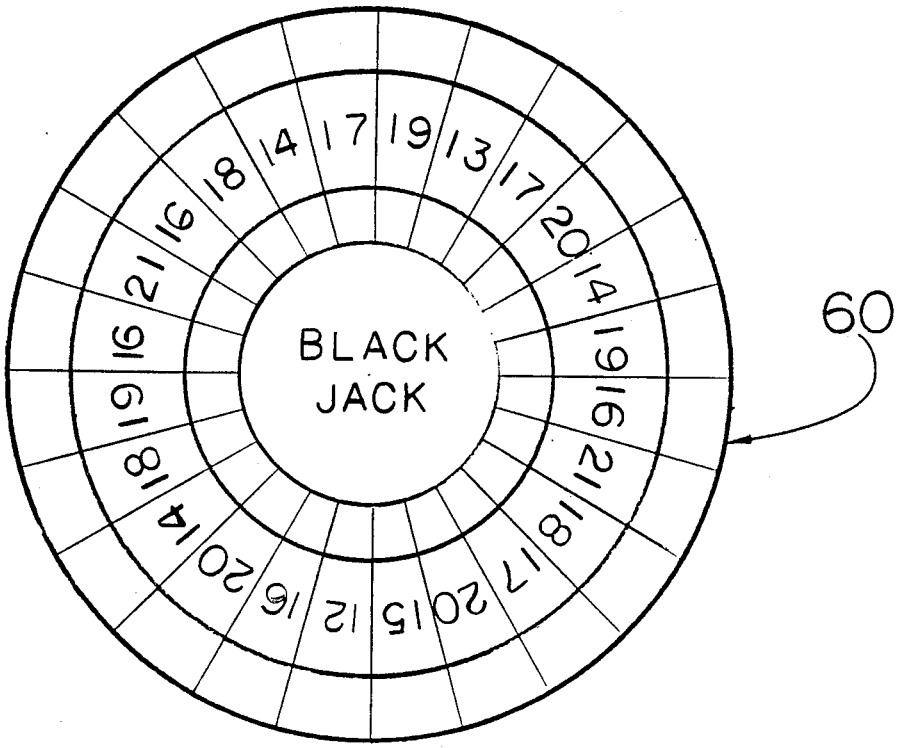
FIG. 7 is a back view of an element of one, two sided gaming disc employed in the preferred embodiment.
Figure 8:
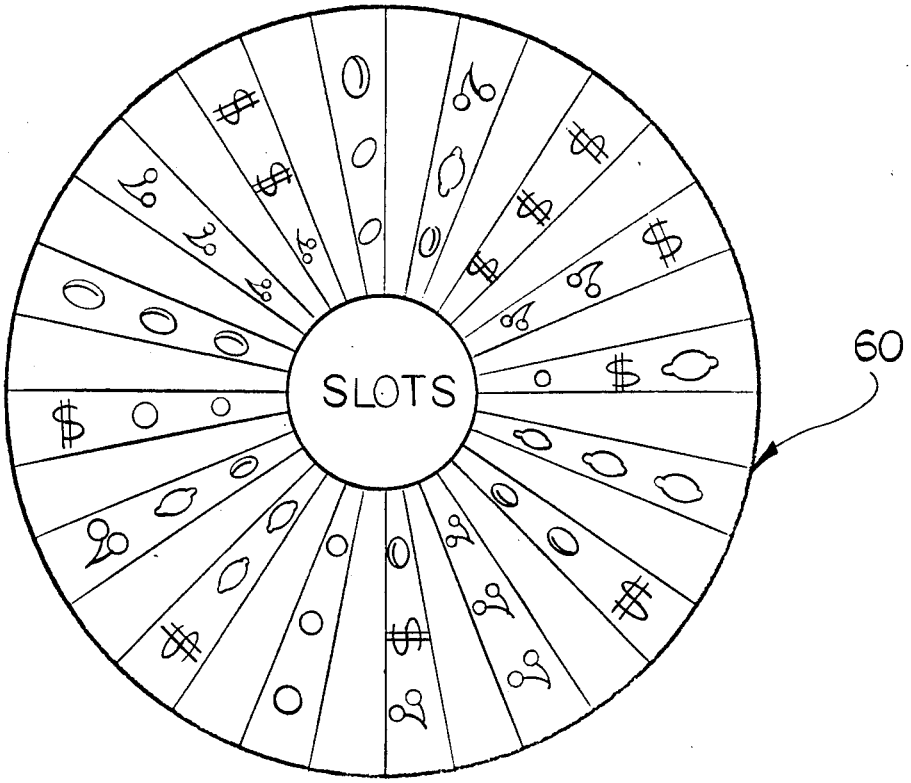
FIG. 8 is a front view of an element of a second, two sided gaming disc employed in the preferred embodiment.
Figure 9:
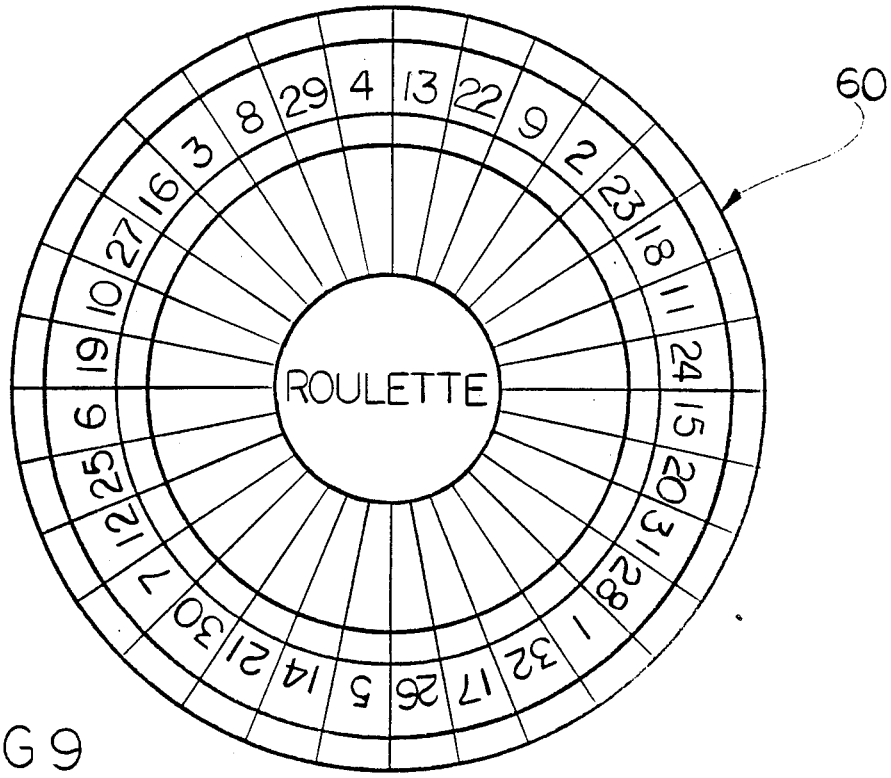
FIG. 9 is a back view of an element of a second, two sided gaming disc employed in the preferred embodiment.

The gaming discs 60 are made of a durable material such as heavyweight cardboard, each having a center opening. Each side of the disc 60 as shown in FIGS. 6 and 7, represent a simulated game played in a real-life gaming atmosphere. Each side of the disc is divided into several different sections, each section representing the outcome of a gaming play. Such sections of each side of the disc is of a different design or pattern, as is obvious in FIGS. 6 7, 8 and 9. Each section carries a number and or design or pattern.

The pair of dice 20 shown in FIG. 2, serves as a random number generating means when rolled. The spots on the dice represent the numbers generated. When playing the game, both dice 20 are used in moving around the main path 15 and only one die is used in moving around the four gaming paths 25.

Preferably six playing pieces 30 are utilized. The playing pieces are differentiated from one another by color and or structure or other appropriate means. Each player uses only one playing piece. The intervals defined on the game board 10 support the playing pieces 30 during movement. With each number generated by one or more of the dice 20, each playing piece advances a conforming number of intervals. The movement of each playing piece according to the number generated by one roll of at least one die defines one turn. The players move their playing pieces in rotation.

Lucky day and expense cards 40 are utilized in the game. Each card is made of a durable material, such as a lightweight cardboard. On the front side of the cards, the type of card is printed, i.e., lucky day or expense. Printed on the reverse side of the card is a description of the subject matter involved for each particular card.

LUCKY DAY CARDS

1. YOUR LUCKY NUMBERS PAY OFF AT KENO—COLLECT $50,000.
2. THIS CARD GOOD TOWARD ONE $5,000 SPIN ON ROULETTE.
3. ADVANCE TO CASINO OF YOUR CHOICE—DO NOT COLLECT $20,000.
4. AUNT MATILDA WIRES YOU MONEY—COLLECT $20,000.
5. ADVANCE TO CASINO OF YOUR CHOICE—DO NOT COLLECT $20,000.
6. ADVANCE TO NEAREST CASINO—COLLECT $20,000 IF YOU PASS START.
7. KEEP THIS CARD—WIN A BRAND NEW CONVERTIBLE VALUE $50,000—RESALE VALUE $40,000.
8. BIG WIN AT CRAPS TABLE—COLLECT $10,000.
9. WIN BET AT HEAVYWEIGHT BOXING CHAMPIONSHIP—COLLECT $5,000.
10. KEEP THIS CARD—WIN A 1935 CLASSIC AUTOMOBILE VALUE $40,000—RESALE VALUE $30,000.
11. BOSS GIVES YOU VACATION BONUS—COLLECT $5,000.
12. THIS CARD GOOD TOWARD ONE $5,000 SPIN AT BLACK JACK.
13. ADVANCE TO CASINO OF YOUR CHOICE—DO NOT COLLECT $20,000.
14. THIS CARD GOOD TOWARD ONE $1,500 SPIN AT SLOTS.
15. ADVANCE TO NEAREST CASINO—COLLECT $20,000 IF YOU PASS START.
16. HIT THE JACKPOT—COLLECT $25,000.
17. ADVANCE TO NEAREST CASINO—COLLECT $20,000 IF YOU PASS START.
18. STOP CASINO ROBBERY—OWNER REWARDS YOU WITH $5,000.
19. ADVANCE TO NEAREST CASINO—COLLECT $20,000 IF YOU PASS START.
20. CREDIT CARD CASH ADVANCE—COLLECT $10,000.
21. ADVANCE TO CASINO OF YOUR CHOICE—DO NOT COLLECT $20,000.

When used during playing of the game, the lucky day cards 40 are randomly shuffled and placed in a stack with their reverse sides down on the lucky day card position 18 of the game board 10. Upon the playing piece terminating movement on a lucky day interval 75 the player selects the topmost lucky day card in the stack and follows instructions. The shuffled stack of lucky day cards serves as a means for randomly supplying one of a plurality of lucky day choices of rewards. The card is placed reverse side down at the bottom of the stack after it is viewed, or retained if so indicated.

EXPENSE CARDS

Preferably twenty-one expense cards 40 are utilized in the game. The subject matter printed on the reverse side of the twenty-one cards is set forth below:

1. TAKEN BY SHILLS—LOSE $1,000.
2. CREDIT CARD PAYMENT DUE—PAY $2,000.
3. LOSE ONE TO MANY HANDS AT BLACK JACK—PAY $5,000.
4. MUGGED ON WAY TO AIRPORT—LOSE $2,000.
5. PAY $500 FOR PHOTOS AT CABARET SHOW.
6. HAVING SUCH A GOOD TIME PURCHASE DINNER RING—PAY $10,000.
7. PAY $5,000 FOR WEDDING CEREMONY AND LASTING MEMORY PHOTOGRAPHS.
8. LOSE BIG AT HIGH STAKES POKER—PAY $10,000.
9. TAKE SIDE TRIP TO WORLD'S LARGEST CAR SHOW—PAY $2,000.

10. CRAPPED OUT—LOSE $5,000.
11. MAKE RESERVATIONS FOR ANNUAL PIG FARMERS CONVENTION—PAY $1,000.
12. WHEEL OF FORTUNE SPINS RIGHT PASS YOU—LOSE $2,500.
13. BUY SOUVENIRS FOR THE GANG BACK HOME—PAY $1,000.
14. BUY STOCK IN NEW CASINO—PAY $5,000.
15. I.R.S. AUDIT—PAY 20% OF ALL YOUR CASH.
16. PAY $1,500 FOR CHARITY DINNER AND SHOW.
17. CHARTER 30' YACHT FOR WEDDING CELEBRATION—PAY $2,500.
18. TAKE GOLF LESSONS—PAY $2,000 FOR NEW GOLF CLUBS.
19. ORDER DRINK AT BLACK JACK TABLE—LOSE $1,000 WHILE WAITING.
20. MAKE SIDE BET AT SUMMER RODEO—LOSE $2,000.
21. VALET PARKING WRECKS YOUR NEW CAR—PAY $15,000 FOR REPAIRS.

When used during playing of the game, the expense cards 40 are randomly shuffled and placed in a stack with their reverse sides down on the expense card position 16 of the game board 10. Upon the playing piece terminating movement on an expense interval 80, the player selects the topmost expense card in the stack and follows directions. The shuffled stack of expense cards serves as a means for randomly supplying one of a plurality of expense choices of penalties. The expense card is placed reverse side down at the bottom of the stack after it is viewed.

The manner in which the game is played is apparent from a description of the game rules.

Before the game begins, one player is selected to act as banker and dealer, and preferably a second player to act as alternate dealer. The banker handles all transactions involving money. The banker pays the salaries and winnings, and collects only the money lost while betting. Any amount of tokens may occupy the same interval at any given time. If at any point during the playing of the game a player loses all their money and does not have enough money to bet with or pay penalties, the player is automatically removed from the game. In preparation, the Lucky Day and Expense cards 40 are randomly shuffled in their respective stacks and the stacks are placed on the positions 16 and 18, respectively on the game board 10. One playing piece 30 is selected by each player and positioned on the START reference interval 70 of the main path 10.

The banker initially distributes $100,000 to each player in the following denominations and quantities: $50,000 (one); $20,000 (one); $10,000 (two); $5,000 (one); $1,000 (four); and $500 (two).

The minimum or maximum amount a player may bet per game of chance is printed on each entrance interval 77 of the gaming paths 25 and on intervals 71, 82 to 86, and on the gaming rules 27.

To start the game each player in turn throws the dice 20, the player with the highest total starts the game, followed by the sequence of players in a clockwise direction. Play begins on the main path 15 where additional money is acquired to enable players to enter any gaming path 25. When playing on the main path 15, both dice 20 are rolled to advance the playing pieces 30 clockwise. Each player takes a turn by rolling the dice and moving the playing pieces the number of intervals equal to the number supplied by the dice. At the end of each turn, the interval upon which the playing piece 30 has terminated movement designates a reward or penalty. If a monetary reward, the player must collect from the banker. All monetary expenses, including those incurred on expense cards, will be paid to the Jackpot interval 72, where the money will be placed along the outside perimeter of the board 10 next to interval 72. When a playing piece terminates movement on interval 72, player will collect all money that has accumulated in the Jackpot 72 at that time. If a playing piece 30 lands on interval 79, it constitutes a loss of one turn, the player may, however, place a bet if another player lands on the Open House interval 73.

If a playing piece terminates movement on a lucky day or expense interval 75 and 80, player selects the topmost card from the deck indicated on the interval, and follows instructions. The card is then returned reverse side down to the bottom of the stack unless otherwise indicated. Player winning a car from the lucky day cards 75, has two options; player may keep the card the entire length of the game and use the value of the car towards the money needed to win the game, or if desired, player may exchange the car for money. If the car is exchanged for money, the lucky day card 40 is returned to the bottom of the lucky day stack 17 reverse side down and the banker will advance the player the resale value of the car as indicated on the lucky day card 40. When a playing piece terminates movement on any gaming path entrance 77, or if a player is instructed to advance to a gaming path interval 25, player must meet the entrance requirements of that particular path. Each gaming path has individual entrance requirements, if a player can't meet the entrance requirements of a particular gaming path, the player may not enter that path, then on the players following turn, the player must continue around the main path.

After player accumulates enough money on the main path 15, play may begin on the gaming paths 25. Once on a gaming path, only one die is rolled to dictate advancement along the gaming path. After each roll of the die, player must play the game indicated on the interval upon which the playing piece terminates movement. After following gaming instructions, player ends their turn.

To complete a gaming path 25, the playing piece 30 must proceed through the gaming path and land somewhere on the main path 15.

The winner of the game is the first player to obtain one million dollars in cash and or prizes.

While the current invention has been illustrated and described as a simulated gaming vacation, and method of playing same, it is not to be limited to the details shown, since various modifications and structural changes may be made without omitting features that, from the standpoint of prior art, fairly constitute essential characteristics of the inclusive or specific aspects of this invention and, therefore, such adaptions should and are intended to be comprehended within the meaning and range of equivalence of the foregoing claims:

We claim:

1. A gaming vacation simulation game for simulating a real-life gaming environment for two or more players, comprising:

(a) a plurality of playing pieces representing each player during the use of said board game;

(b) a playing board having a playing surface and including means defining preferably five separate playing paths on the playing surface, each playing path defined by a plurality of separate spaces serially linked, one of the playing paths defining a main path simulating events occuring when on a real-life gaming vacation; the other four playing paths defining a gaming path representing simulated gaming activities in a gaming room environment; the majority of the spaces of the main path being designated by an amount of rewards and penalties to be attributed to a playing piece upon termination of movement on such space and at least a few of the other spaces on the main path being designated as games of chance spaces, wherein said plurality of spaces among said other four playing paths being divided into a plurality of sets of spaces, a first set of spaces being distinguished by indicia to represent a first game of chance, a second set of spaces being distinguished by indicia to represent a second game of chance, a third set of spaces being distinguished by indicia to represent a third game of chance and a fourth set of spaces being distinguished by indicia to represent a fourth game of chance;

(c) a spinner means comprising a pointer and two interchangeable discs, both the obverse and reverse sides of each disc being radially divided into a plurality of areas, all the areas of the obverse side of a first disc only having indicia representing possible outcomes which occur from said game of chance, all the areas of the reverse side of said first disc only having indicia representing possible outcomes which occur from said second game of chance, all the areas of the obverse side of a second disc only having indicia representing possible outcomes which occur from said third game of chance, and all areas of the reverse side of said second disc only having indicia representing possible outcomes which occur from said fourth game of chance.

2. Board game apparatus, as defined in claim 1, further comprising:

a board game with at least two games in one, wherein one main path is defined with a plurality of reward and penalty spaces, and preferably four separate gaming paths are defined with a plurality of different games of chance spaces, each path consisting of different monetary requirements, each individual path having the ability in itself to supply a player with the money needed to win the game.

* * * * *